US011499440B2

(12) United States Patent
Lee et al.

(10) Patent No.: US 11,499,440 B2
(45) Date of Patent: Nov. 15, 2022

(54) TURBINE VANE AND GAS TURBINE INCLUDING THE SAME

(71) Applicant: DOOSAN ENERBILITY CO., LTD, Changwon-si (KR)

(72) Inventors: Hyuk Hee Lee, Gimhae (KR); Sung Chul Jung, Daejeon (KR)

( * ) Notice: Subject to any disclaimer, the term of this patent is extended or adjusted under 35 U.S.C. 154(b) by 0 days.

(21) Appl. No.: 17/340,159

(22) Filed: Jun. 7, 2021

(65) Prior Publication Data

US 2022/0056807 A1 Feb. 24, 2022

(30) Foreign Application Priority Data

Aug. 21, 2020 (KR) ..... 10-2020-0105257

(51) Int. Cl.
*F01D 9/00* (2006.01)
*F01D 9/06* (2006.01)
*F01D 5/18* (2006.01)

(52) U.S. Cl.
CPC ..... *F01D 9/065* (2013.01); *F01D 5/189* (2013.01); *F05D 2220/32* (2013.01); *F05D 2240/12* (2013.01); *F05D 2260/232* (2013.01)

(58) Field of Classification Search
CPC ..... F01D 9/065; F01D 5/189
See application file for complete search history.

(56) References Cited

U.S. PATENT DOCUMENTS

| | | | | |
|---|---|---|---|---|
| 7,097,426 | B2 | 8/2006 | Lee et al. | |
| 7,296,973 | B2 | 11/2007 | Lee et al. | |
| 2003/0170113 | A1* | 9/2003 | Burdgick | F01D 5/189 415/1 |
| 2007/0212228 | A1 | 9/2007 | Digard Brou De Cuissart et al. | |
| 2011/0123351 | A1* | 5/2011 | Hada | F01D 9/065 416/97 R |
| 2014/0093392 | A1* | 4/2014 | Tibbott | F01D 5/188 29/889.6 |
| 2015/0159494 | A1* | 6/2015 | Carrier | F01D 9/02 29/889.22 |
| 2017/0000959 | A1 | 1/2017 | Mantell et al. | |

FOREIGN PATENT DOCUMENTS

| | | | |
|---|---|---|---|
| JP | 5599624 | B1 | 10/2014 |
| KR | 100534813 | B1 | 12/2001 |
| KR | 1020030074315 | A | 9/2003 |
| KR | 1020110074942 | A | 7/2011 |
| KR | 1020200042622 | A | 4/2020 |

* cited by examiner

*Primary Examiner* — Katheryn A Malatek
(74) *Attorney, Agent, or Firm* — Harvest IP Law, LLP

(57) ABSTRACT

A turbine vane and a gas turbine including the same are provided. The turbine vane includes an airfoil having a pressure side and a suction side, at least one cooling channel formed radially in the airfoil, and an insert inserted into the at least one cooling channel to divide the cooling channel into a pressure side passage and a suction side passage.

18 Claims, 9 Drawing Sheets

TURBINE VANE AND GAS TURBINE INCLUDING THE SAME

CROSS-REFERENCE TO RELATED APPLICATION

This application claims priority to Korean Patent Application No. 10-2020-0105257, filed on Aug. 21, 2020, the disclosure of which is incorporated herein by reference in its entirety.

BACKGROUND

Technical Field

Apparatuses and methods consistent with exemplary embodiments relate to a turbine vane and a gas turbine including the same, and more particularly, to a turbine vane whose internal cooling channel is divided by an insert, and a gas turbine including the same.

Description of the Related Art

Turbines are machines that obtain a rotational force by impingement or reaction force using a flow of a compressible fluid such as steam or gas, and include a steam turbine using steam, a gas turbine using hot combustion gas, and so on.

The gas turbine includes a compressor, a combustor, and turbine. The compressor includes an air inlet into which air is introduced, and a plurality of compressor vanes and a plurality of compressor blades alternately arranged in a compressor casing.

The combustor supplies fuel to air compressed by the compressor and ignites a mixture thereof with a burner to produce high-temperature and high-pressure combustion gas.

The turbine includes a plurality of turbine vanes and a plurality of turbine blades alternately arranged in a turbine casing. In addition, a rotor is disposed to pass through centers of the compressor, the combustor, the turbine, and an exhaust chamber.

The rotor is rotatably supported at both ends thereof by bearings. The rotor has a plurality of disks fixed thereto, and a plurality of blades are connected to each of the disks. A drive shaft of a generator is connected to an end of the rotor that is adjacent to the exhaust chamber.

The gas turbine is advantageous in that consumption of lubricant is extremely low due to the absence of mutual friction parts such as a piston-cylinder because the gas turbine does not have a reciprocating mechanism such as a piston which is usually provided in a four-stroke engine, an amplitude of vibration, which is a characteristic of reciprocating machines, is greatly reduced, and it enables high-speed motion.

The operation of the gas turbine is briefly described. The air compressed by the compressor is mixed with fuel so that the mixture thereof is burned to produce hot combustion gas, and the produced combustion gas is discharged to the turbine. The discharged combustion gas generates a rotational force while passing through the turbine vanes and turbine blades, thereby rotating the rotor.

SUMMARY

Aspects of one or more exemplary embodiments provide a turbine vane capable of guiding cold air to flow at an optimum flow rate to each passage by dividing an internal cooling channel of the turbine vane, and a gas turbine including the same.

Additional aspects will be set forth in part in the description which follows and, in part, will become apparent from the description, or may be learned by practice of the exemplary embodiments.

According to an aspect of an exemplary embodiment, there is provided a turbine vane including: an airfoil having a pressure side and a suction side, at least one cooling channel formed radially in the airfoil, and an insert inserted into the at least one cooling channel to divide the cooling channel into a pressure side passage and a suction side passage.

The insert may include a partition configured to divide the at least one cooling channel into the pressure side passage and the suction side passage, a pair of supports extending from both ends of the partition and in close contact with an inner surface of the at least one cooling channel, and a throttle plate coupled to the partition to cover an inlet of the at least one cooling channel.

The throttle plate may include a first throttle hole for introducing cold air into the pressure side passage and a second throttle hole for introducing cold air into the suction side passage.

The second throttle hole may have an area of 1.5 to 2.0 times that of the first throttle hole.

The first throttle hole may include two through-holes, and the second throttle hole may include three or four through-holes.

The throttle plate may be formed integrally with the partition and the pair of supports by welding.

The partition may include a communication hole formed through a radially inner portion of the partition so that the pressure side passage and the suction side passage communicate with each other.

The communication hole may include two or more communication holes formed near a lower portion of the partition and spaced apart from each other by a predetermined radial distance.

The partition may be disposed at an inclination of 80 to 50 degrees with respect to the pair of supports to divide the at least one cooling channel into the pressure side passage and the suction side passage.

The partition may be in a form of a thin plate.

According to an aspect of another exemplary embodiment, there is provided a gas turbine including: a compressor configured to compress outside air, a combustor configured to mix fuel with the air compressed by the compressor to burn a mixture thereof, and a turbine having a turbine blade and a turbine vane in a turbine casing to rotate the turbine blade by combustion gas discharged from the combustor, wherein the turbine vane includes an airfoil having a pressure side and a suction side, at least one cooling channel formed radially in the airfoil, and an insert inserted into the at least one cooling channel to divide the cooling channel into a pressure side passage and a suction side passage.

The insert may include a partition configured to divide the at least one cooling channel into the pressure side passage and the suction side passage, a pair of supports extending from both ends of the partition to be in close contact with an inner surface of the at least one cooling channel, and a throttle plate coupled to the partition to cover an inlet of the at least one cooling channel.

The throttle plate may include a first throttle hole for introducing cold air into the pressure side passage and a second throttle hole for introducing cold air into the suction side passage.

The second throttle hole may have an area of 1.5 to 2.0 times that of the first throttle hole.

The first throttle hole may include two through-holes, and the second throttle hole may include three or four through-holes.

The throttle plate may be formed integrally with the partition and the pair of supports by welding.

The partition may include a communication hole formed through a radially inner portion of the partition so that the pressure side passage and the suction side passage communicate with each other.

The communication hole may include two or more communication holes formed near a lower portion of the partition and spaced apart from each other by a predetermined radial distance.

The partition may be disposed at an inclination of 80 to 50 degrees with respect to the pair of supports to divide the at least one cooling channel into the pressure side passage and the suction side passage.

The partition may be in a form of a thin plate.

BRIEF DESCRIPTION OF THE DRAWINGS

The above and other aspects will become more apparent from the following description of the exemplary embodiments with reference to the accompanying drawings, in which.

DETAILED DESCRIPTION

Figure 1:
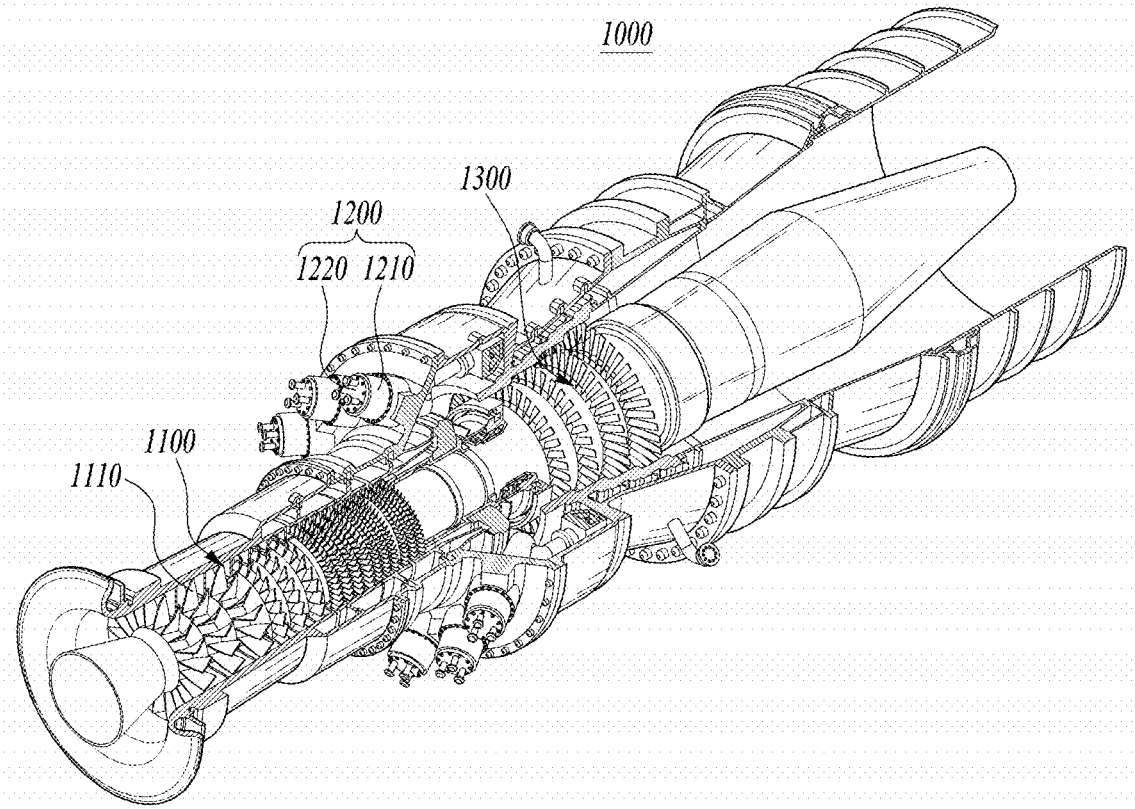
FIG. 1 is a partial cutaway perspective view illustrating a gas turbine according to an exemplary embodiment.

Various modifications and various embodiments will be described in detail with reference to the accompanying drawings so that those skilled in the art can easily carry out the disclosure. It should be understood, however, that the various embodiments are not for limiting the scope of the disclosure to the specific embodiment, but they should be interpreted to include all modifications, equivalents, and alternatives of the embodiments included within the spirit and scope disclosed herein.

The terminology used herein is for the purpose of describing specific embodiments only and is not intended to limit the scope of the disclosure. The singular expressions "a", "an", and "the" are intended to include the plural expressions as well unless the context clearly indicates otherwise. In the disclosure, terms such as "comprises", "includes", or "have/has" should be construed as designating that there are such features, integers, steps, operations, components, parts, and/or combinations thereof, not to exclude the presence or possibility of adding of one or more of other features, integers, steps, operations, components, parts, and/or combinations thereof Hereinafter, exemplary embodiments will be described in detail with reference to the accompanying drawings. It should be noted that like reference numerals refer to like parts throughout the different drawings and exemplary embodiments. In certain embodiments, a detailed description of functions and configurations well known in the art may be omitted to avoid obscuring appreciation of the disclosure by a person of ordinary skill in the art. For the same reason, some components may be exaggerated, omitted, or schematically illustrated in the accompanying drawings.

Figure 2:
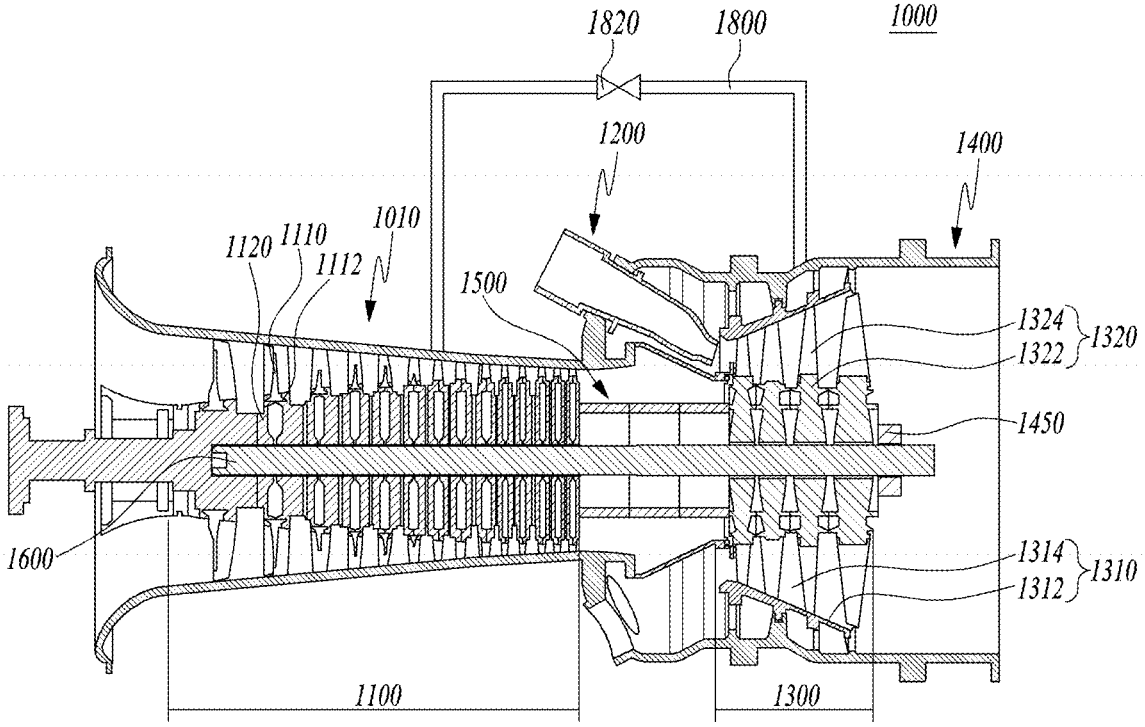
FIG. 2 is a cross-sectional view illustrating a schematic structure of the gas turbine according to the exemplary embodiment.
Figure 3:
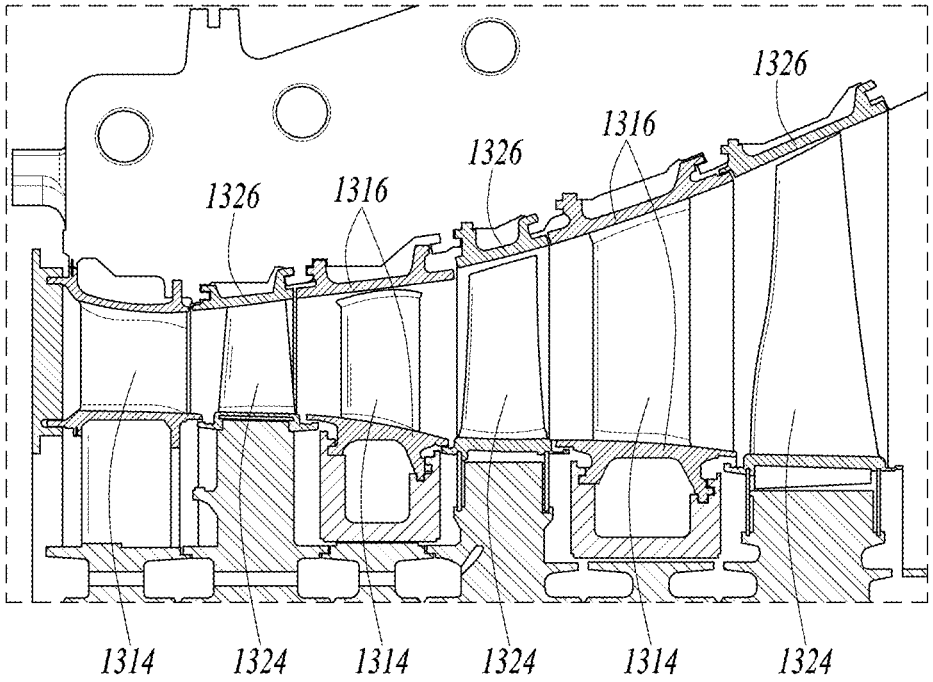
FIG. 3 is a partial cross-sectional view illustrating an internal structure of the gas turbine according to the exemplary embodiment.

FIG. 1 is a partial cutaway perspective view illustrating a gas turbine according to an exemplary embodiment. FIG. 2 is a cross-sectional view illustrating a schematic structure of the gas turbine according to the exemplary embodiment. FIG. 3 is a partial cross-sectional view illustrating an internal structure of the gas turbine according to the exemplary embodiment.

Referring to FIG. 1, the gas turbine 1000 according to the exemplary embodiment includes a compressor 1100, a combustor 1200, and a turbine 1300. The compressor 1100 includes a plurality of blades 1110 which are arranged radially. The compressor 1100 rotates the plurality of blades 1110, and air is compressed and flows by the rotation of the plurality of blades 1110. A sizes and installation angles of each of the plurality of blades 1110 may vary depending on an installation position thereof The compressor 1100 may be directly or indirectly connected to the turbine 1300, and receive some of power generated by the turbine 1300 and use the received power to rotate the plurality of blades 1110.

The air compressed by the compressor 1100 flows to the combustor 1200. The combustor 1200 includes a plurality of combustion chambers 1210 and fuel nozzle modules 1220 which are arranged in an annular shape.

Referring to FIG. 2, the gas turbine 1000 includes a housing 1010 and a diffuser 1400 disposed behind the housing 1010 to discharge the combustion gas passing through the turbine 1300. The combustor 1200 is disposed in front of the diffuser 1400 to combust the compressed air supplied thereto.

Based on a flow direction of air, the compressor 1100 is disposed at an upstream side, and the turbine 1300 is disposed at a downstream side. Between the compressor 1100 and the turbine 1300, a torque tube 1500 serving as a torque transmission member for transmitting the rotational torque generated in the turbine 1300 to the compressor 1100 is disposed.

The compressor 1100 includes a plurality of compressor rotor disks 1120, each of which is fastened by a tie rod 1600 to prevent axial separation in an axial direction of the tie rod 1600.

For example, the compressor rotor disks 1120 are aligned with each other along an axial direction in such a way that the tie rod 1600 forming a rotary shaft passes through centers of the compressor rotor disks 1120. Here, adjacent compressor rotor disks 1120 are arranged so that facing surfaces thereof are in tight contact with each other by the tie rod 1600. The adjacent compressor rotor disks 1120 cannot rotate relative to each other because of this arrangement.

Each of the compressor rotor disks 1120 has a plurality of blades 1110 radially coupled to an outer peripheral surface thereof. Each of the blades 1110 has a dovetail 1112 fastened to the compressor rotor disk 1120.

A plurality of compressor vanes are fixedly arranged between each of the compressor rotor disks 1120. While the compressor rotor disks 1120 rotate along with a rotation of the tie rod 1600, the compressor vanes fixed to the housing 1010 do not rotate. The compressor vanes guide a flow of compressed air moved from front-stage compressor blades 1110 of the compressor rotor disk 1120 to rear-stage compressor blades 1110 of a compressor rotor disk 1120.

The dovetail 1112 may be fastened in a tangential type or an axial type, which may be selected according to the structure required for the gas turbine used.

This type may have a dovetail shape or fir-tree shape. In some cases, the compressor blades 1110 may be fastened to the compressor rotor disk 1120 by using other types of fastener, such as a key or a bolt.

The tie rod 1600 is disposed to pass through centers of the plurality of compressor rotor disks 1120 and turbine rotor disks 1322. The tie rod 1600 may be a single tie rod or consist of a plurality of tie rods. One end of the tie rod 1600 is fastened to the compressor rotor disk that is disposed at the most upstream side, and the other end thereof is fastened by a fixing nut 1450.

It is understood that the tie rod 1600 may have various shapes depending on the structure of the gas turbine, and is not limited to example illustrated in FIG. 2.

For example, a single tie rod may be disposed to pass through the centers of the rotor disks, a plurality of tie rods may be arranged circumferentially, or a combination thereof may be used.

Also, a deswirler serving as a guide vane may be installed at the rear stage of the diffuser in order to increase the pressure of fluid in the compressor of the gas turbine and to adjust an actual flow angle of the fluid entering into an inlet of the combustor.

The combustor 1200 mixes fuel with the introduced compressed air, burns a mixture thereof to produce high-temperature and high-pressure combustion gas with high energy, and increases the temperature of the combustion gas to a heat-resistant limit of combustor and turbine components through an isobaric combustion process.

A plurality of combustors constituting the combustor 1200 may be arranged in a housing in a form of a shell. Each of the combustors may include a burner having a fuel injection nozzle and the like, a combustor liner defining a combustion chamber, and a transition piece serving as a connection between the combustor and the turbine.

The combustor liner provides a combustion space in which the fuel injected by the fuel injection nozzle is mixed with the compressed air supplied from the compressor. The combustor liner may include a flame container providing the combustion space in which the mixture of air and fuel is burned, and a flow sleeve defining an annular space surrounding the flame container. The fuel injection nozzle is coupled to a front end of the combustor liner, and an ignition plug is coupled to a side wall of the combustor liner.

The transition piece is connected to a rear end of the combustor liner to transfer the combustion gas burned by the ignition plug toward the turbine. An outer wall of the transition piece is cooled by the compressed air supplied from the compressor to prevent the transition piece from being damaged by the high temperature combustion gas.

To this end, the transition piece has cooling holes through which the compressed air can be injected. The compressed air cools the inside of the transition piece through the cooling holes and then flows toward the combustor liner.

The compressed air used to cool the transition piece may flow into the annular space of the combustor liner, and may impinge on the cooling air supplied from the outside of the flow sleeve through the cooling holes formed in the flow sleeve to an outer wall of the combustor liner.

The high-temperature and high-pressure combustion gas ejected from the combustor 1200 is supplied to the turbine 1300. The supplied high-temperature and high-pressure combustion gas expands and impinges on the blades of the turbine and applies impingement or reaction force to the turbine blades to generate rotational torque. A portion of the rotational torque is transmitted via the torque tube to the compressor, and the remaining portion which is the excessive torque is used to drive a generator or the like.

The turbine 1300 basically has a structure similar to that of the compressor. That is, the turbine 1300 also includes a turbine rotor 1320 similar to the rotor of the compressor 1100. The turbine rotor 1320 includes a plurality of turbine rotor disks 1322 and a plurality of turbine blades 1324 which are arranged radially. The turbine blades 1324 may also be coupled to the turbine rotor disk 1322 in a dovetail manner or the like.

In addition, a plurality of turbine vanes 1314 fixed in a turbine casing 1312 are provided between the turbine blades 1324 of the turbine rotor disk 1322 to guide a flow direction of the combustion gas passing through the turbine blades 1324. In this case, the turbine casing 1312 and the turbine vanes 1314 corresponding to fixing bodies may be collectively referred to as a turbine stator 1310 in order to distinguish them from the turbine rotor 1320 corresponding to a rotating body.

Referring to FIG. 3, the turbine vanes 1314 are fixedly mounted in the turbine casing 1312 by vane carriers 1316, which are endwalls coupled to inner and outer ends of each of the turbine vanes 1314. On the other hand, a ring segment 1326 is mounted to the inner surface of the turbine casing at a position facing the outer end of each of the turbine blades 1324 with a predetermined gap. That is, the gap formed between the ring segment 1326 and the outer end of the turbine blade 1324 is defined as a tip clearance.

Referring back to FIG. 2, the turbine blade 1324 comes into direct contact with high-temperature and high-pressure combustion gas. The turbine blade 1324 may be deformed by the combustion gas, and the turbine 1300 may be damaged by the deformation of the turbine blade 1324. In order to prevent deformation due to such high temperature, a branch passage 1800 may be formed between the compressor 1100 and the turbine 1300 so that a part of the air having a temperature relatively lower than that of the combustion gas may be branched into the compressor 1100 and supplied to the turbine blade 1324.

The branch passage 1800 may be formed outside the compressor casing or may be formed inside the compressor casing by passing through the compressor rotor disk 1120. The branch passage 1800 may supply the compressed air branched from the compressor 1100 into the turbine rotor disk 1322. The compressed air supplied into the turbine rotor disk 1322 flows radially outward, and may be supplied into the turbine blade 1324 to cool the turbine blade 1324. In addition, the branch passage 1800 connected to the outside of the housing 1010 may supply the compressed air branched from the compressor 1100 into the turbine casing 1312 to cool the inside of the turbine casing 1312. The branch passage 1800 may be provided with a valve 1820 in a middle thereof to selectively supply compressed air. The branch passage 1800 may be connected with a heat exchanger to selectively further cool compressed air prior to supply.

Figure 4:
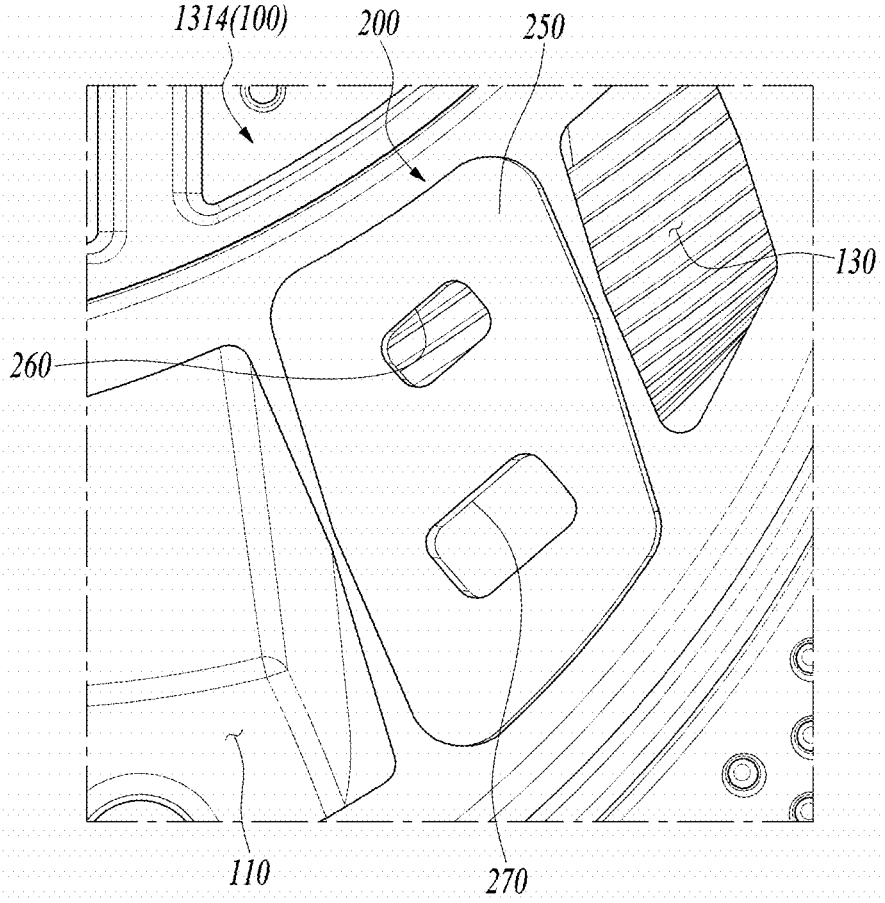
FIG. 4 is a partial perspective view illustrating a state in which an insert according to a first example of the exemplary embodiment is inserted into a cooling channel of a turbine vane.
Figure 5:
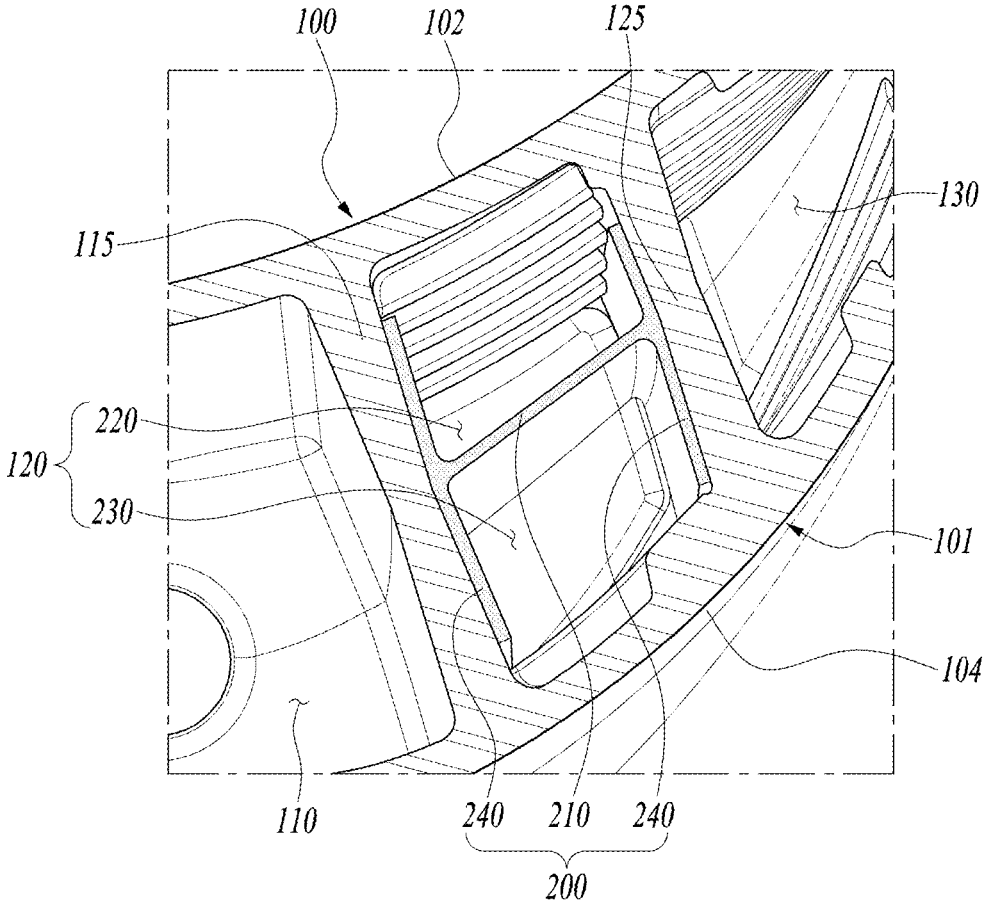
FIG. 5 is a partial perspective view illustrating a state in which a throttle plate is omitted from the insert inserted into the cooling channel of the turbine vane.
Figure 6:
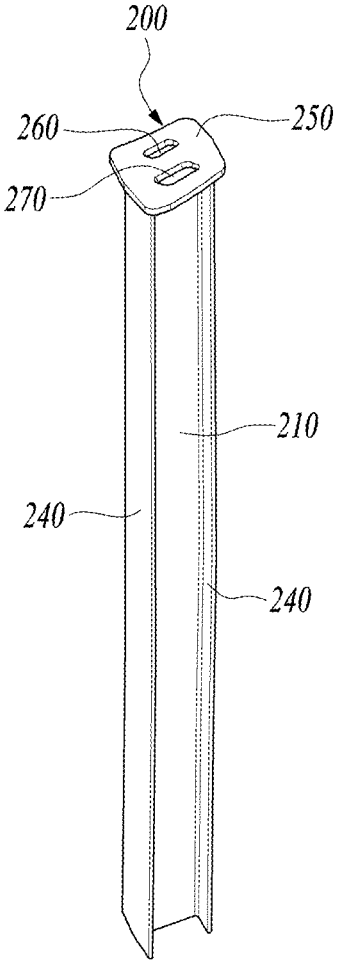
FIG. 6 is a perspective view illustrating the insert according to the first example.
Figure 7:
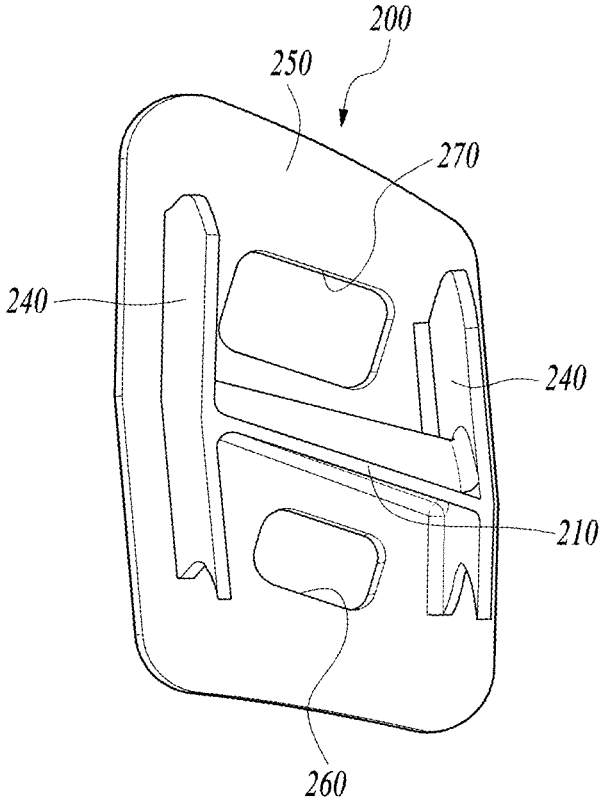
FIG. 7 is a perspective view illustrating the throttle plate of the insert according to the first example.
Figure 8:
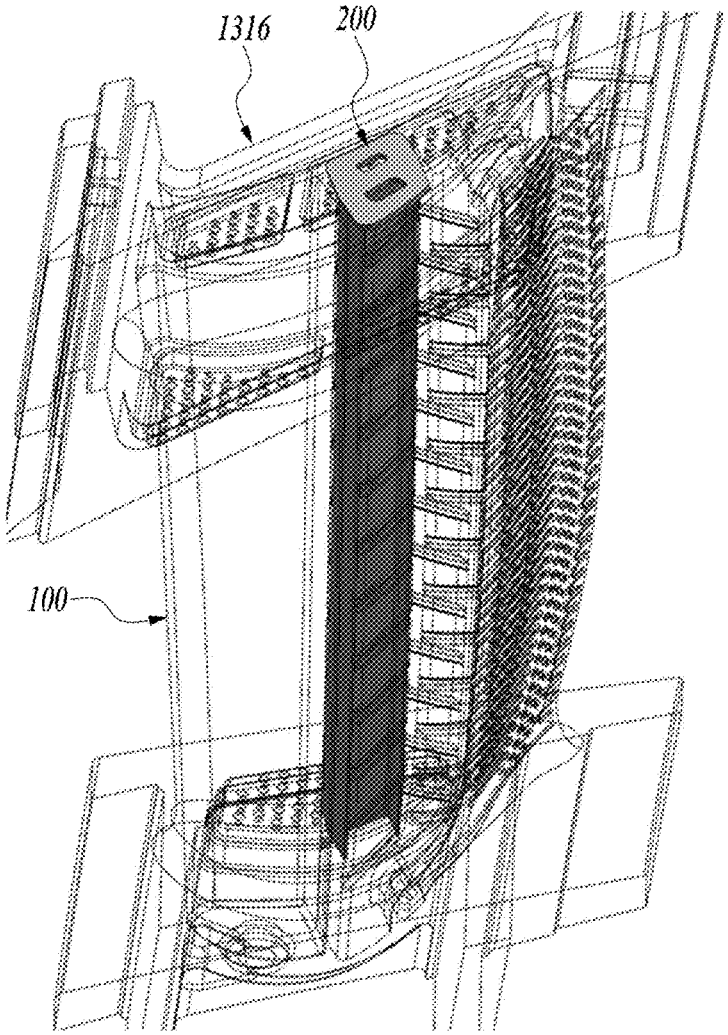
FIG. 8 is a perspective view illustrating a state in which the insert is inserted into the turbine vane according to the first example.

FIG. 4 is a partial perspective view illustrating a state in which an insert according to a first example of the exemplary embodiment is inserted into a cooling channel of each of the turbine vanes. FIG. 5 is a partial perspective view illustrating a state in which a throttle plate is omitted from the insert inserted into the cooling channel of the turbine vane. FIG. 6 is a perspective view illustrating the insert according to the first example. FIG. 7 is a perspective view illustrating the throttle plate of the insert according to the first example. FIG. 8 is a perspective view illustrating a state in which the insert is inserted into the turbine vane according to the first example.

Referring to FIGS. 4 and 5, each turbine vane 100 (or also designated by reference numeral 1314) according to the exemplary embodiment may include an airfoil 101 having a pressure side 102 and a suction side 104, at least one cooling channel 110, 120, or 130 formed radially in the airfoil 101, and an insert 200 inserted into the at least one cooling channel to divide the cooling channel into a pressure side passage 220 and a suction side passage 230.

As described above, the turbine vane 100 may be fixedly mounted to the turbine casing 1312 by the vane carriers 1316 coupled to the radially inner and outer sides of the turbine vane 100. The airfoil 101 of the turbine vane 100 may include a concave pressure side 102 on the sidewall thereof, a convex suction side 104 on the side opposite thereto, a relatively sharp leading edge, and a relatively blunt trailing edge.

Referring to FIG. 5, the at least one cooling channel may include a plurality of cooling channels, for example, a first cooling channel 110, a second cooling channel 120, and a third cooling channel 130. The first and second cooling channels 110 and 120 may be partitioned by a partition wall 115, and the second and third cooling channels 120 and 130 may be partitioned by a partition wall 125. Each of the partition walls 115 and 125 may have a flat side, or a curved side.

Some of the air compressed by the compressor 1100 may be introduced radially into the first cooling channel 110, flow out of the first cooling channel 110, flow radially in second cooling channel 120 from the outside to the inside thereof, flow radially in the third cooling channel 130 from the inside to the outside thereof, and then may be discharged from the turbine vane 100.

The insert 200 may be inserted into the second cooling channel 120 to divide the second cooling channel 120 into two passages, i.e., a pressure side passage 220 and a suction side passage 230. FIGS. 4 and 5 illustrate that the insert 200 is inserted into the second cooling channel 120. However, it is understood that the insert 200 may not be limited to the example illustrated in FIGS. 4 and 5, and the insert 200 may be selectively inserted and mounted in the first cooling channel 110 and/or the third cooling channel 130.

The insert 200 may include a partition 210 that divides the cooling channel 120 into the pressure side passage 220 and the suction side passage 230, and a pair of supports 240 extending from both ends of the partition 210 and in close contact with an inner surface of the cooling channel 120, and a throttle plate 250 coupled to the partition 210 to cover an inlet of the cooling channel 120.

The partition 210 may divide the second cooling channel 120 into two flow spaces, i.e., the pressure side passage 220 close to the pressure side 102 and the suction side passage 230 close to the suction side 104. To this end, the partition 210 may be in a form of a thin plate. In the pressure side passage 220 and the suction side passage 230 divided by the partition 210, the suction side passage 230 may have a volume equal to or greater than the pressure side passage 220.

The pair of supports 240 may extend toward both the pressure side 102 and the suction 104 from both ends of the partition 210 to be in close contact with the inner surface of the cooling channel 120. If the inner surface of the second cooling channel 120 is curved, the supports 240 may also be curved. The partition 210 and the pair of supports 240 may form an approximately "H"-shape in cross section taken in a circumferential direction.

Referring to FIG. 4, a throttle plate 250 having a plurality of holes for inflow of air may be coupled to the partition 210 to cover the inlet of the second cooling channel 120. The throttle plate 250 may be approximately a square plate as a whole and have rounded vertices. The throttle plate 250 may be formed integrally with the pair of supports 240 as well as the partition 210 by welding.

The throttle plate 250 may include a first throttle hole 260 for introducing cold air into the pressure side passage 220 and a second throttle hole 270 for introducing cold air into the suction side passage 230. The first throttle hole 260 may be formed in an approximately central portion of the pressure side passage 220 of the throttle plate portion 250 and may have a rectangular shape with rounded vertices. The second throttle hole 270 may be formed in an approximately central portion of the suction side passage 230 of the throttle plate portion 250 and may have a rectangular shape with rounded vertices.

The second throttle hole 270 may have an area of 1.5 to 2.0 times the size of the first throttle hole 260. Because the temperature of the suction side 104 is higher than that of the pressure side 102 when the gas turbine is operated, it is necessary to increase the flow of cold air to the suction side passage 230. Therefore, by forming the second throttle hole 270 larger than the first throttle hole 260, it is possible to introduce more cold air into the suction side passage 230 than the pressure side passage 220. This is the same even if the size of the suction side passage 230 is the same as the size of the pressure side passage 220.

Referring to FIGS. 6 to 8, the insert 200 may be inserted approximately close to a deep bottom of the second cooling channel 120. On the contrary, the insert 200 may have a length that can be inserted only up to about ⅔ to ¾ of the depth of the second cooling channel 120, so that the cold air introduced into the two passages is mixed at the lower portion of the second cooling channel 120 and flows to the third cooling channel 130.

For example, cold air is introduced into the first cooling channel 110 through an inlet hole of the vane carrier 1316 on the radially inner side of the turbine vane 100, and cold air is introduced into the throttle holes 260 and 270 of the insert 200 through a plurality of outlet holes formed in the vane carrier 1316 on the radially outer side of the turbine vane 100. The cold air branched into the pressure side passage 220 and the suction side passage 230 is introduced through a passage formed in the vane carrier 1316 on the radially inner side of the turbine vane 100 into the third cooling channel 130 to flow therein and is then discharged from the turbine vane 100.

Referring to FIG. 8, the cold air may flow from bottom to top in the first cooling channel 110, flow from top to bottom in the second cooling channel 120 divided into the pressure side passage 220 and the suction side passage 230, and then flow from bottom to top in the third cooling channel 130. In this way, the cold air which is compressed air may be used to cool the turbine vane 100 while flowing in a zigzag form through the cooling channels formed inside the turbine vane 100. Because the cold air flows in the second cooling channel 120 divided into the pressure side passage 220 and the suction side passage 230 by the insert 200, the cold air flows at an optimum flow rate for each flow space. Therefore, it is possible to efficiently cool the turbine vane 100.

Figure 9:
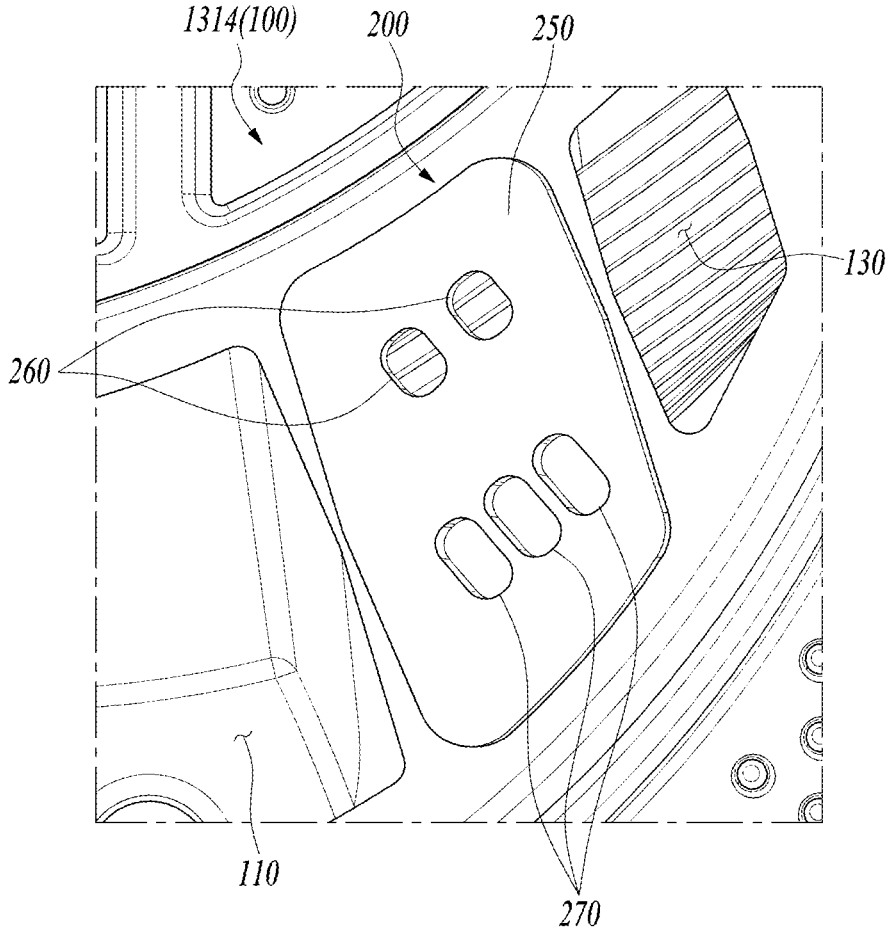
FIG. 9 is a perspective view illustrating a throttle plate of an insert according to a second example of the exemplary embodiment.

FIG. 9 is a perspective view illustrating a throttle plate of an insert according to a second example of the exemplary embodiment.

Referring to FIG. 9, the insert 200 may include a first throttle hole 260 including two through-holes and a second throttle hole 270 including three through-holes.

Here, each throttle hole may consist of a plurality of through-holes having different numbers rather than each having a different size.

For example, the first throttle hole 260 may include two through-holes and the second throttle hole 270 may include three through-holes. In this case, cold air may be introduced into a suction side passage 230 at a flow rate of 1.5 times or more through the second throttle hole 270 compared to the first throttle hole 260.

Figure 10:
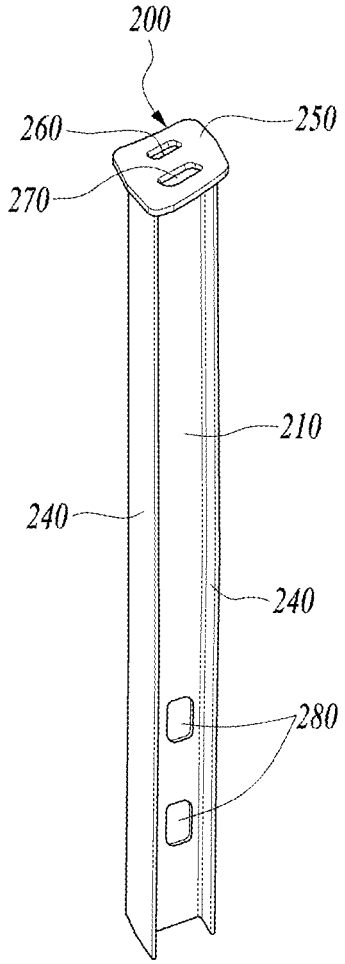
FIG. 10 is a perspective view illustrating an insert according to a third example of the exemplary embodiment.

FIG. 10 is a perspective view illustrating an insert according to a third example of the exemplary embodiment.

Referring to FIG. 10, the insert 200 may include a partition 210 having a communication hole 280 formed through the radially inner portion thereof so that a pressure side passage 220 and a suction side passage 230 can communicate with each other.

The communication hole 280 may include two or more communication holes formed near a lower portion of the partition 210 and spaced apart from each other by a predetermined radial distance.

By forming the communication hole 280 at the lower portion of the partition 210 of the insert 200, the cold air flowing in the pressure side passage 220 and the cold air flowing in the suction side passage 230 may be mixed at the lower portion of the partition 210.

Figure 11:
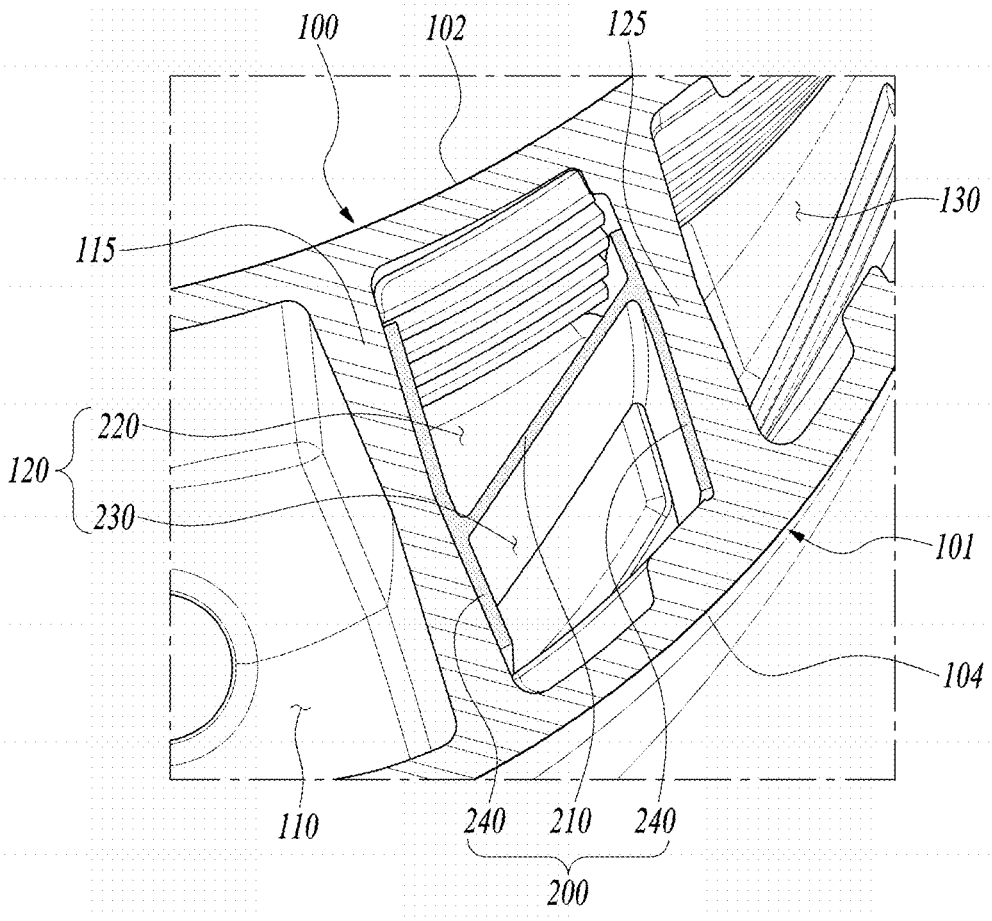
FIG. 11 is a partial cutaway perspective view illustrating an insert according to a fourth example of the exemplary embodiment.

FIG. 11 is a partial cutaway perspective view illustrating an insert according to a fourth example of the exemplary embodiment.

Referring to FIG. 11, the insert 200 may include a partition 210 disposed at an inclination of 80 to 50 degrees with respect to a pair of supports 240 to divide a cooling channel 120 into a pressure side passage 220 and a suction side passage 230.

Here, the partition 210 may be connected to each of the supports 240 at an angle of approximately 60 degrees to divide the second cooling channel 120 into the pressure side passage 220 and the suction side passage 230.

If the partition 210 is integrally connected to the supports 240 to divide the second cooling channel 120 into the pressure side passage 220 and the suction side passage 230, the partition 210 may be disposed at an inclination of 80 to 50 with respect to the supports 240. This angle of inclination means an acute angle among the angles formed by the partition 210 and the supports 240. It is understood that this is only an example, and angles of inclination at which the partition 210 is connected to the two supports 240 may be different from each other.

By changing the inclination angle of the partition 210 with respect to the supports 240, the cold air may be distributed at an appropriate flow rate and flow to the pressure side passage 220 and the suction side passage 230.

According to the turbine vane and the gas turbine including the same, it is possible to guide cold air to flow at an optimal flow rate to each passage by dividing the internal cooling channel of the turbine vane.

While one or more exemplary embodiments have been described with reference to the accompanying drawings, it will be apparent to those skilled in the art that various variations and modifications may be made by adding, changing, or removing components without departing from the spirit and scope of the disclosure as defined in the appended claims, and these variations and modifications fall within the spirit and scope of the disclosure as defined in the appended claims. Accordingly, the description of the exemplary embodiments should be construed in a descriptive sense only and not to limit the scope of the claims, and many alternatives, modifications, and variations will be apparent to those skilled in the art

What is claimed is:

1. A turbine vane comprising:

an airfoil having a pressure side and a suction side;

at least one cooling channel formed radially in the airfoil; and an insert inserted into the at least one cooling channel, wherein the insert comprises:

a partition configured to divide the at least one cooling channel into a pressure side passage and a suction side passage, wherein a volume of the suction side passage is greater than a volume of the pressure side passage;

a pair of supports including a first support and a second support, the first support extending from a first end of the partition and the second support extending from a second end of the partition, the first support defining a leading edge boundary of the pressure side passage on a leading edge side of the at least one cooling channel and defining a leading edge boundary of the suction side passage on the leading edge side of the at least one cooling channel, and the second support defining a trailing edge boundary of the pressure side passage on a trailing edge side of the at least one cooling channel and defining a trailing edge boundary of the suction side passage on the trailing edge side of the at least one cooling channel; and a throttle plate coupled to the partition to cover an inlet of the at least one cooling channel.

2. The turbine vane according to claim 1, wherein the throttle plate comprises a first throttle hole for introducing cold air into the pressure side passage and a second throttle hole for introducing the cold air into the suction side passage.

3. The turbine vane according to claim 2, wherein the second throttle hole has an area of 1.5 to 2.0 times that of the first throttle hole.

4. The turbine vane according to claim 2, wherein the first throttle hole includes two through-holes; and the second throttle hole includes three or four through-holes.

5. The turbine vane according to claim 1, wherein the throttle plate is formed integrally with the partition and the pair of supports by welding.

6. The turbine vane according to claim 5, wherein the partition comprises a communication hole formed through a radially inner portion of the partition so that the pressure side passage and the suction side passage communicate with each other.

7. The turbine vane according to claim 6, wherein the communication hole comprises two or more communication holes formed in the radially inner portion of the partition and spaced apart from each other by a predetermined radial distance.

8. The turbine vane according to claim 5, wherein the partition is disposed at an inclination of 80 to 50 degrees with respect to the pair of supports to divide the at least one cooling channel into the pressure side passage and the suction side passage.

9. The turbine vane according to claim 1, wherein the partition is in a form of a thin plate.

10. A gas turbine comprising:

a compressor configured to compress outside air;

a combustor configured to mix fuel with the air compressed by the compressor to burn a mixture thereof; and a turbine having a turbine blade and a turbine vane in a turbine casing to rotate the turbine blade by combustion gas discharged from the combustor, wherein the turbine vane comprises: an airfoil having a pressure side and a suction side;

at least one cooling channel formed radially in the airfoil; and an insert inserted into the at least one cooling channel, wherein the insert comprises:

a partition configured to divide the at least one cooling channel into a pressure side passage and a suction side passage, wherein a volume of the suction side passage is greater than a volume of the pressure side passage;

a pair of supports including a first support and a second support, the first support extending from a first end of the partition and the second support extending from a second end of the partition, the first support defining a leading edge boundary of the pressure side passage on a leading edge side of the at least one cooling channel and defining a leading edge boundary of the suction side passage on the leading edge side of the at least one cooling channel, and the second support defining a trailing edge boundary of the pressure side passage on a trailing edge side of the at least one cooling channel and defining a trailing edge boundary of the suction side passage on the trailing edge side of the at least one cooling channel; and a throttle plate coupled to the partition to cover an inlet of the at least one cooling channel.

11. The gas turbine according to claim 10, wherein the throttle plate comprises a first throttle hole for introducing cold air into the pressure side passage and a second throttle hole for introducing the cold air into the suction side passage.

12. The gas turbine according to claim 11, wherein the second throttle hole has an area of 1.5 to 2.0 times that of the first throttle hole.

13. The gas turbine according to claim 11, wherein the first throttle hole includes two through-holes; and the second throttle hole includes three or four through-holes.

14. The gas turbine according to claim 10, wherein the throttle plate is formed integrally with the partition and the pair of supports by welding.

15. The gas turbine according to claim 14, wherein the partition comprises a communication hole formed through a radially inner portion of the partition so that the pressure side passage and the suction side passage communicate with each other.

16. The gas turbine according to claim 15, wherein the communication hole comprises two or more communication holes formed in the radially inner portion of the partition and spaced apart from each other by a predetermined radial distance.

17. The gas turbine according to claim 14, wherein the partition is disposed at an inclination of 80 to 50 degrees with respect to the pair of supports to divide the at least one cooling channel into the pressure side passage and the suction side passage.

18. The gas turbine according to claim 10, wherein the partition is in a form of a thin plate.

* * * * *